United States Patent [19]

Bull

[11] Patent Number: 4,788,898

[45] Date of Patent: Dec. 6, 1988

[54] CONTROL FOR A BOBBIN CARRIER

[75] Inventor: Jeffrey F. Bull, Akron, Ohio

[73] Assignee: Karg Corporation, Tallmadge, Ohio

[21] Appl. No.: 134,840

[22] Filed: Dec. 18, 1987

[51] Int. Cl.[4] ..... D04C 3/18; B65H 59/02

[52] U.S. Cl. ..... 87/57; 87/22; 87/55; 242/156.2

[58] Field of Search ..... 87/20–22, 87/55–57; 242/156, 156.1, 156.2

[56] References Cited

U.S. PATENT DOCUMENTS

| | | | |
|---|---|---|---|
| 2,897,716 | 4/1959 | Olson | 87/57 |
| 3,038,367 | 6/1962 | Karg et al. | 87/22 |
| 3,362,282 | 1/1968 | Karg | 87/22 |
| 3,425,315 | 2/1969 | Kaufmann | 87/22 |
| 3,686,997 | 8/1972 | Strangfeld | 87/57 |
| 3,756,533 | 9/1973 | DeYoung | 242/156.2 |
| 3,757,904 | 9/1973 | DeYoung | 87/57 X |
| 3,802,643 | 4/1974 | DeYoung | 242/156 |
| 3,839,939 | 10/1974 | Wily | 87/57 |
| 4,529,147 | 7/1985 | Bull et al. | 87/57 X |
| 4,719,838 | 1/1988 | DeYoung | 87/57 |

*Primary Examiner*—John Petrakes
*Attorney, Agent, or Firm*—Mack D. Cook, II

[57] ABSTRACT

A bobbin control mechanism for a strand carrier for operational mounting before a braid point on a strand fabricating machine. A carrier base member (28) has an axial post (29) for rotatable mounting of a bobbin. The carrier has a series of posts radially around the axial post, a series of guide rollers, a mechanism for tensioning a moving strand on the guide rollers and a reciprocating rod (55) projecting into the base member and reacting to strand tension. The bobbin control mechanism (60) includes a finger cam (61) connected to the reciprocating rod, a free cam (62) movable by the finger cam, a ratchet gear (63) rotatable around the base of the axial post, a first pawl cam (64) preventing clockwise rotation of the ratchet gear, and a second pawl cam (65) preventing counter-clockwise rotation of the ratchet gear. A detachable cover plate (66) around the axial post closes off the interior of the base member. A spool drive ring (69) is connected to a spool control side flange (25) above the axial post and to the ratchet gear through the cover plate.

8 Claims, 5 Drawing Sheets

'FIG -2-

CONTROL FOR A BOBBIN CARRIER

BACKGROUND OF THE INVENTION

The invention relates generally to the efficient operation of strand fabricating machines. More specifically, the invention relates to improved carriers for strand supply bobbins use on strand fabricating machines. Precisely stated, the invention relates to an improved mechanism for control of a strand supply bobbin during active use on a bobbin carrier.

A. The inventor's patents in the art of strand fabricating machines and bobbin carriers are ultimately assigned for commercial use to Karg Corporation, Akron (Tallmadge) Ohio, U.S.A. As either sole or joint inventor, the inventor's United States Letters patents in these arts are listed next below; by number, date, proper name and U.S. Classification (and short title).

U.S. Pat. No. 4,529,147 7/1985, Bull and Winiasz, Class 242/156.2 (carrier); U.S. Pat. No. 4,535,672, 8/1985, Bull and Winiasz, Class 87/29 (machine); U.S. Pat. No. 4,535,674, 8/1985, Bull, Johnson, J. Karg and Winiasz, Class 87/29 (machine); U.S. Pat No. 4,535,675, 8/1985, Bull, D. Karg and Winiasz, Class 87/29 (machine); and U.S. Pat No. 4,620,473, 11/1986, Bull, Class 87/48 (machine).

B. As an engineer, the inventor is well acquainted with the design, operation and maintenance of strand fabricating machines and bobbin carriers being made, used and sold by Karg Corporation, Akron (Tallmadge) Ohio U.S.A. according to the subject matter of Unites States Letters Patent as listed next below; by number, date, proper name and U.S. Classification (and short title). U.S. Pat. No. 3,038,367, 6/1962, F. Karg and J. Karg, Class 87/22 (carrier); U.S. Pat. No. 3,362,282, 1/1968, Karg, Class 87/22 (carrier); U.S. Pat. No. 3,756,117, 9/1973, DeYoung, Class 87/29 (machine); U.S. Pat. No. 3,756,523, 9/1973, DeYoung, Class 242/46.6 (carrier part); U.S. Pat No. 3,756,533, 9/1973, DeYoung, Class 242/156.2 (carrier, mechanism for controlling actuator rod 50); U.S. Pat. No. 3,757,904, 9/1973, DeYoung, Class 188/82.3 (carrier, with reciprocating actuator rod 50); U.S. Pat. No. 3,802,643, 4/1974, DeYoung, Class 242/156 (carrier, mechanism for controlling actuator rod 50; U.S. Pat No. 4,266,461, 5/1981, Molitors, Class 87/29 (tandem machines); and U.S. Pat. No. 4,535,673, 8/1985, Winiasz, Class 87/29 (machine).

C. As an engineer and designer, the inventor knows the disclosure of United States Letters Patents relevant to the subject matter of the present invention. These prior patents issued to other inventors are listed next below; by number, date, proper name and U.S. Classification (and short title).

U.S. Pat. No. 3,425,315, 2/1969, Kaufmann, et al, Class 87/22, (four-post carrier, with tension member 71 and reciprocating bar 117 to actuate strand supply bobbin control mechanism).

U.S. Pat. No. 3,686,997, 8/1972, Strangefeld, Class 87/57 (carrier and strand supply bobbin control mechanism).

U.S. Pat. No. 3,839,939, 10/1974, Wily, Class 87/57 (four-post carrier, with tension member 33 and reciprocating "finger" 96 to actuate strand supply bobbin control mechanism).

From study of the prior patent art, from observation of actual machine, carriers and bobbin control and with field experience, the inventor has concluded that the rotation of strand supply bobbins during active use on carriers mounted on operating strand fabricating machines or "braiders" can be made a more efficient operation with an improved mechanism for control of the various bobbins now in use.

SUMMARY OF THE INVENTION

It is an object of the invention to provide an improved carrier for a strand supply bobbin used on strand fabricating machines.

It is a further object of the invention to provide a strand carrier with instantaneous braking action as well as accurate tension settings within working tolerances and minimum variations in tension during strand release and letoff.

These and other objects of the invention as well as the advantages thereof, will become apparent in view of the drawings and the detailed description.

The invention specifically relates to a bobbin control mechanism carried by and mounted within the base member of a carrier.

The invention may be used in a conventional environment wherein the base member is operationally mounted before a braid point on a strand fabricating machine. As is conventional, a bobbin comprises a spool, a package of wound strand material and a letoff length or free end of strand material extending in a movement path from the bobbin to the braid point. A bobbin spool has a control side flange and an opposed side flange carried by an elongate hub. Also as conventional is a base member having an axial post for rotatable mounting of the bobbin.

The invention may be used for bobbin control on a wide range of known or commercial carriers. Such carriers as would be improved by the subject matter of the invention will have: post means located radially around the axial post; post means which support means for guiding the strand along the movement path; means for tensioning a moving strand in contact with the guide means, and a reciprocating rod movable in response to the strand tensioning means.

The subject matter of the invention is a means to control bobbin rotation around the axial post during strand path movement. The bobbin control means is carried by and mounted within the base member. The control means has movable components housed in suitably shaped cavities in the base member and including: a finger cam connected to the reciprocating rod; a free cam movable by the finger cam; a ratchet gear rotatable around the base of the axial post; a first pawl cam normally biased to prevent rotation of the ratchet gear in one direction (e.g. clockwise); and, a second pawl cam normally biased to prevent rotation of the ratchet gear in a second direction (e.g. counter-clockwise).

Another feature of the invention is that the free cam, ratchet gear and biased pawl cams are each oriented within the base member and movable in a common plane perpendicular to the axis of rotation of the spool.

Still according to the invention, a bobbin control means may have a detachable cover plate around the axial post and closing over the interior of the base member and the suitably shaped cavities, and a spool drive ring interconnecting with the spool control side flange. The drive ring is attached to the ratchet gear through the cover plate.

IN THE DRAWINGS

DETAILED DESCRIPTION OF THE INVENTION

Figure 1:
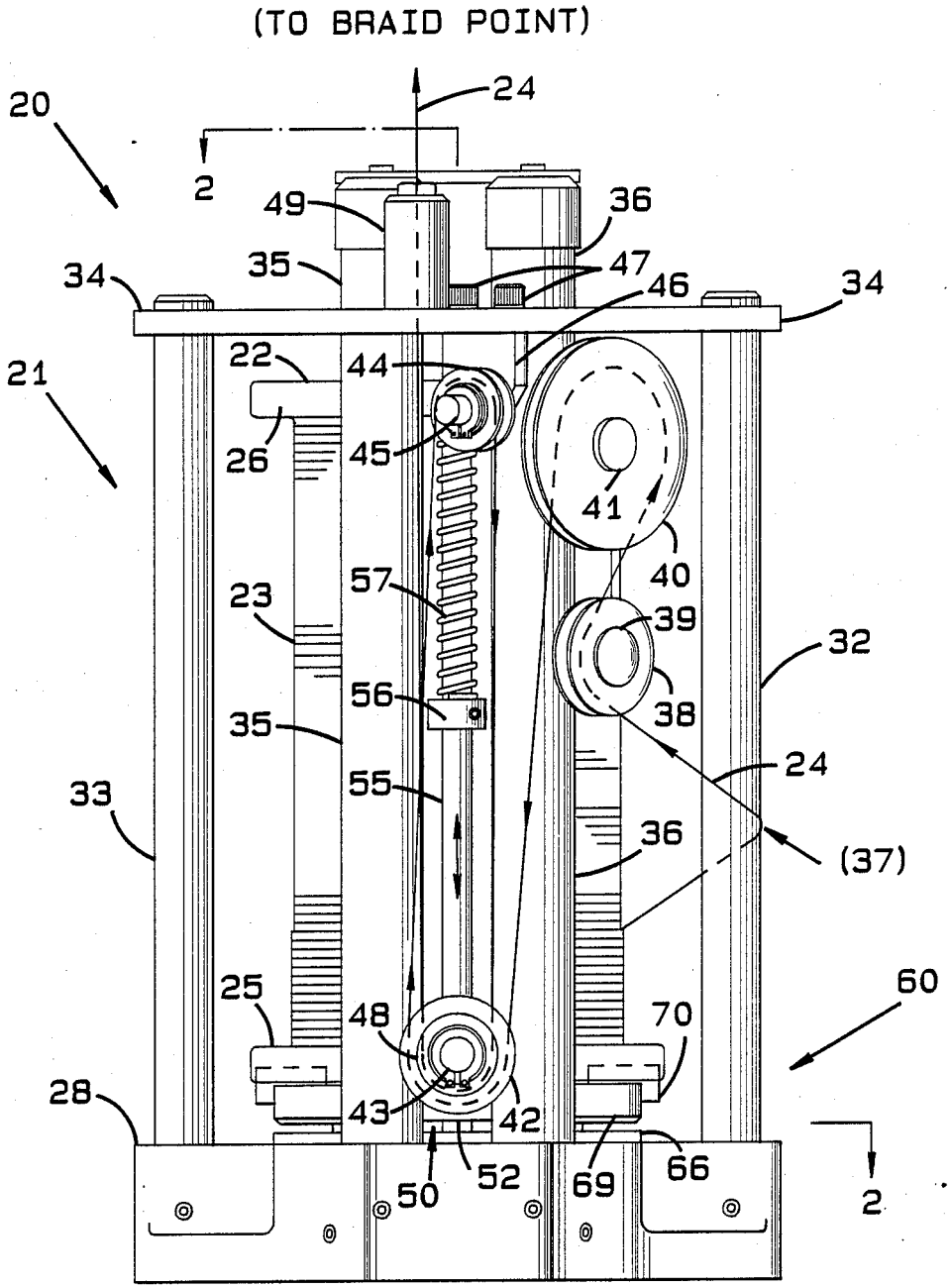
FIG. 1 is a front elevation of a strand carrier and bobbin and a bobbin control means according to the invention.
Figure 2:
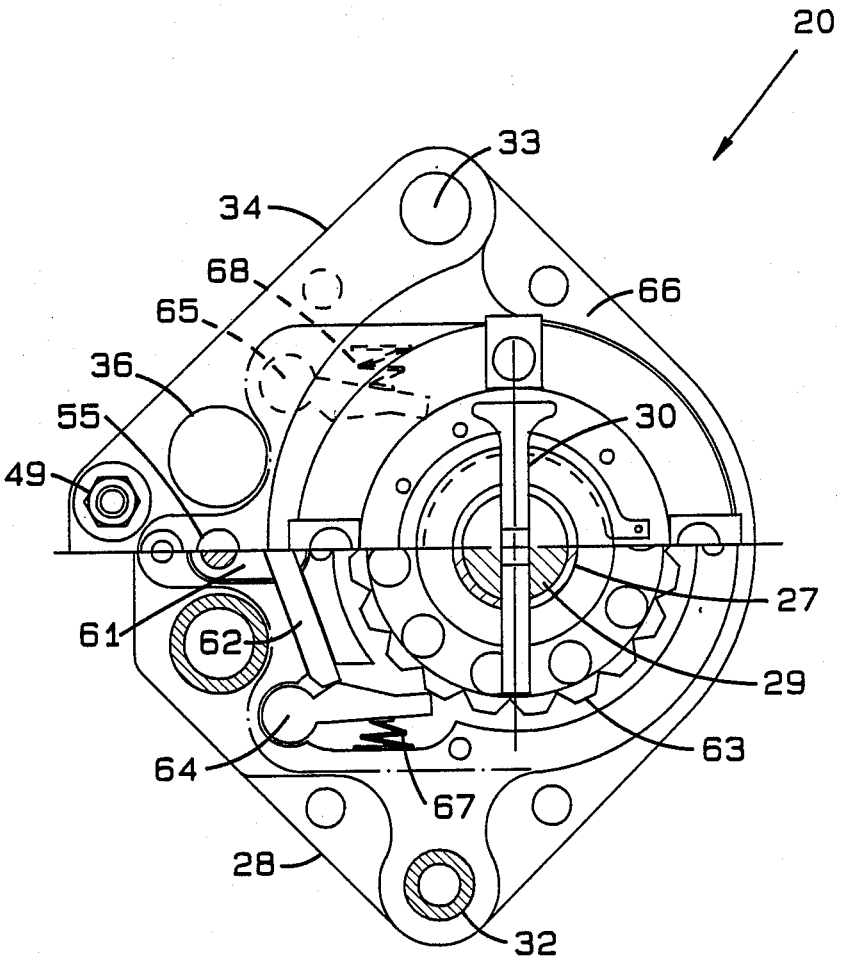
FIG. 2 is a top view, half in full view and half in section, showing the apparatus of FIG. 1.

A carrier for a strand supply bobbin, according to the invention, is referred to generally by the numeral 20. A strand supply bobbin is referred to generally by the numeral 21. A bobbin 21 comprises a spool 22, a package of wound strand material 23, and a let off length or free end of strand material 24.

A bobbin spool 22 has a base or control side flange 25 and an opposed top side flange 26 carried by an elongate hub 27. A strand package 23 is tightly wound around the hub 27, between side flanges 25 and 26, prior to installation of the bobbin 21 and spool 22 on the carrier 20.

A carrier 20 has a base member 28 adapted for rotatable mounting of a strand supply bobbin 21 and for rotational movement on a conventional strand fabricating machine having a braid point (not shown). The base member 28 carries an axial post 29 for insertion within the spool hub 27 and selective retention thereon by a spring retainer assembly 30.

The carrier base member 28 has a series of sockets 31, located radially around the axial bobbin post 29. In the embodiment shown, the carrier 20 is a "four-post carrier." Two of the sockets 31 mount opposed posts 32, 33 extending upwardly to mount a top plate 34 for structural support. Intermediate hollow posts 35, 36 are mounted in the two sockets 31 between the posts 32, 33.

The post means (32, 33, 35 and 36), located radially around the axial bobbin post 29, provide support and mounting for component means for guiding strand material 24 along a path of movement from a bobbin 21 to a braid point of the conventional strand fabricating machine (not shown).

In the embodiment shown, the strand guide means begin at a post 32 having an elongate guide surface (indicated at 37). After wrapping over the post surface 37, the strand 24 is led to a first roller 38 bearing mounted on a stud 39 projecting from a post 36. After movement around the roller 38, the strand 24 is led to a second roller 40 bearing mounted on a stud 41 projecting from the upper end of a post 36. After reversal around the roller 40, the strand 24 returns toward the base member 28 and a third roller 42 bearing mounted on a longer stud 43 projecting laterally from between intermediate posts 35, 36. After reversal around the roller 42, the strand 24 moves away from the base member 28 and toward a fourth roller 44 bearing mounted on a stud 45 projecting from a support 46 attached by cap screws 47 to the post top plate 34. After reversal around the roller 44, the strand 24 again returns toward the base member 28 and a fifth roller 48. The roller 48 is bearing mounted on the long stud 43 outwardly of the third roller 42. After reversal around the roller 48, the strand 24 moves away from the base member 28 and passes through an eyelet 49 carried on the post top plate 34 toward the braid point of the conventional strand fabricating machine (not shown).

The carrier 20 has a means for tensioning a moving strand 24 in contact with the guide means (surface 37, rollers 38, 40, 42, 44 and 48, eyelet 49).

In the embodiment shown, the strand tensioning means includes a double barrel slide actuator indicated at 50. The actuator 50 is housed for vertical movement, in response to the tension of a moving strand 24, within the hollow interiors of intermediate posts 35, 36. The facing sides of the posts 35, 36 each have a vertically directed elongate slot 51. Each intermediate post slot 51 receives a slide flange extending laterally from the medial portion 52 of an actuator 50 to interconnect with an adjacent cylindrical barrel 53.

Figure 3:
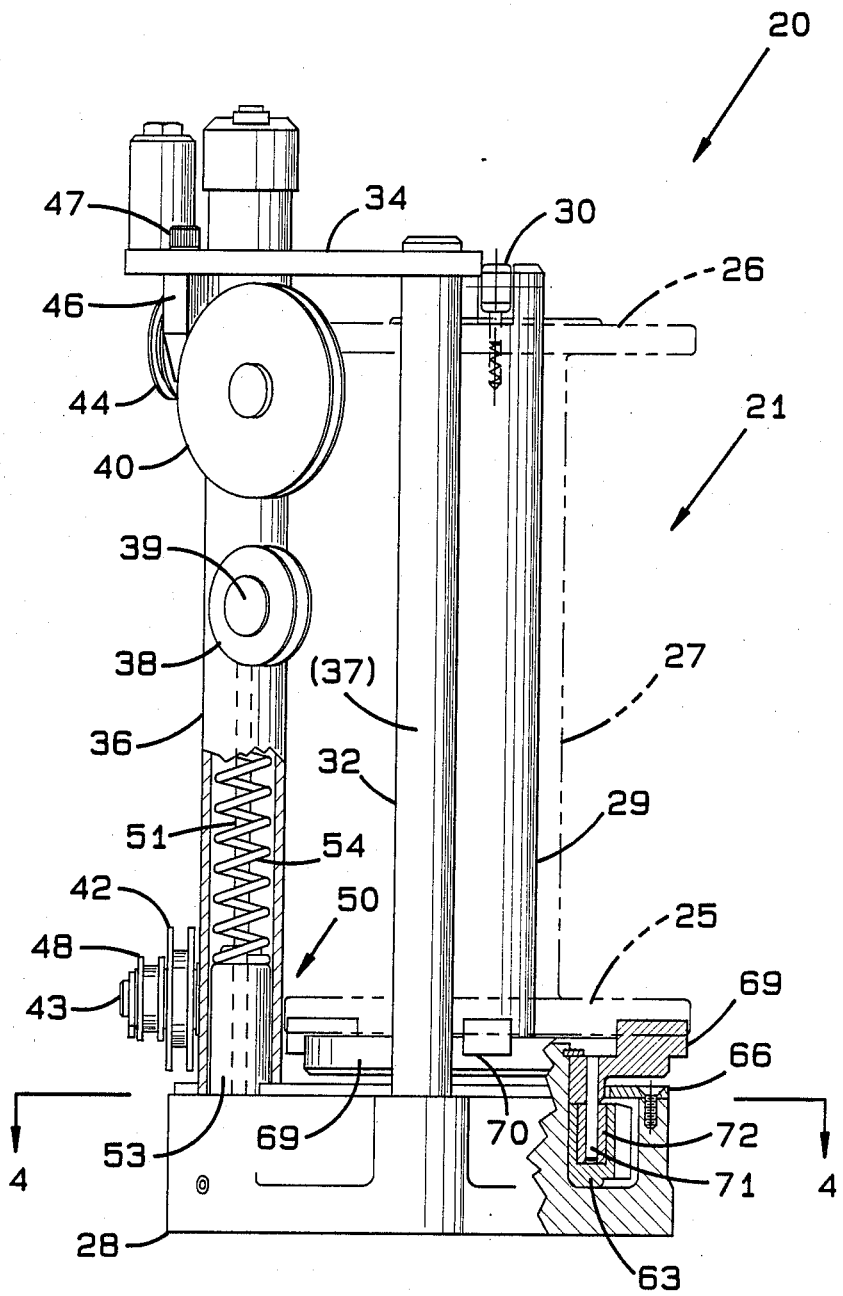
FIG. 3 is a side elevation of the apparatus of FIG. 1, with a left side section showing components of the strand tensioning means and a right side section showing components of the bobbin control means.
Figure 4:
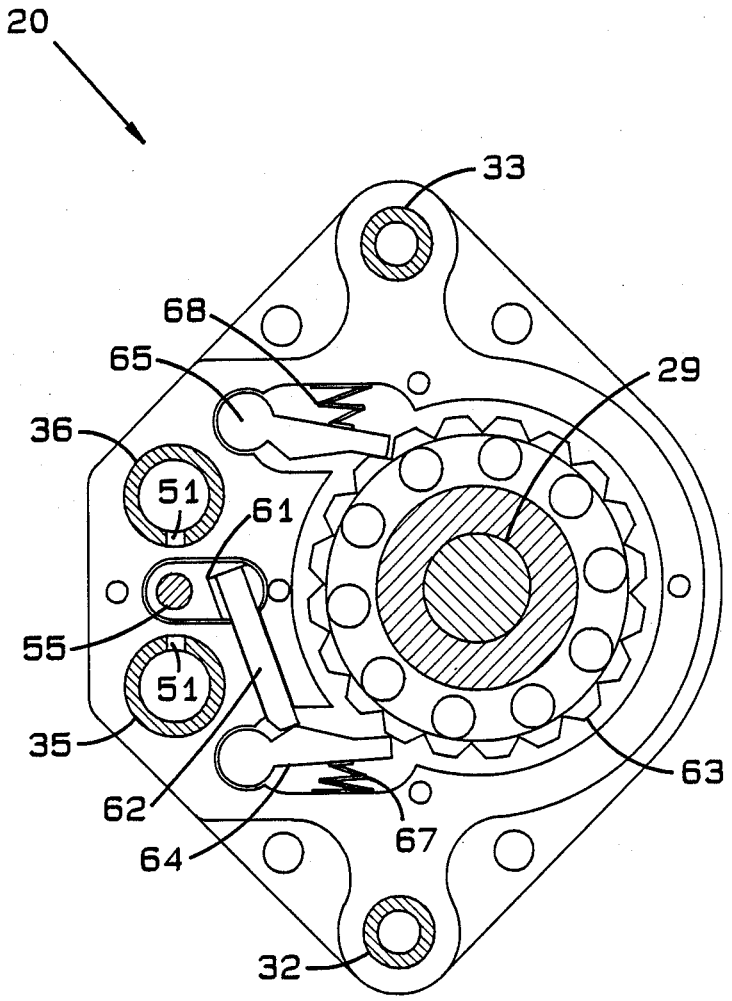
FIG. 4 is a top section showing components of the bobbin control means.
Figure 5:
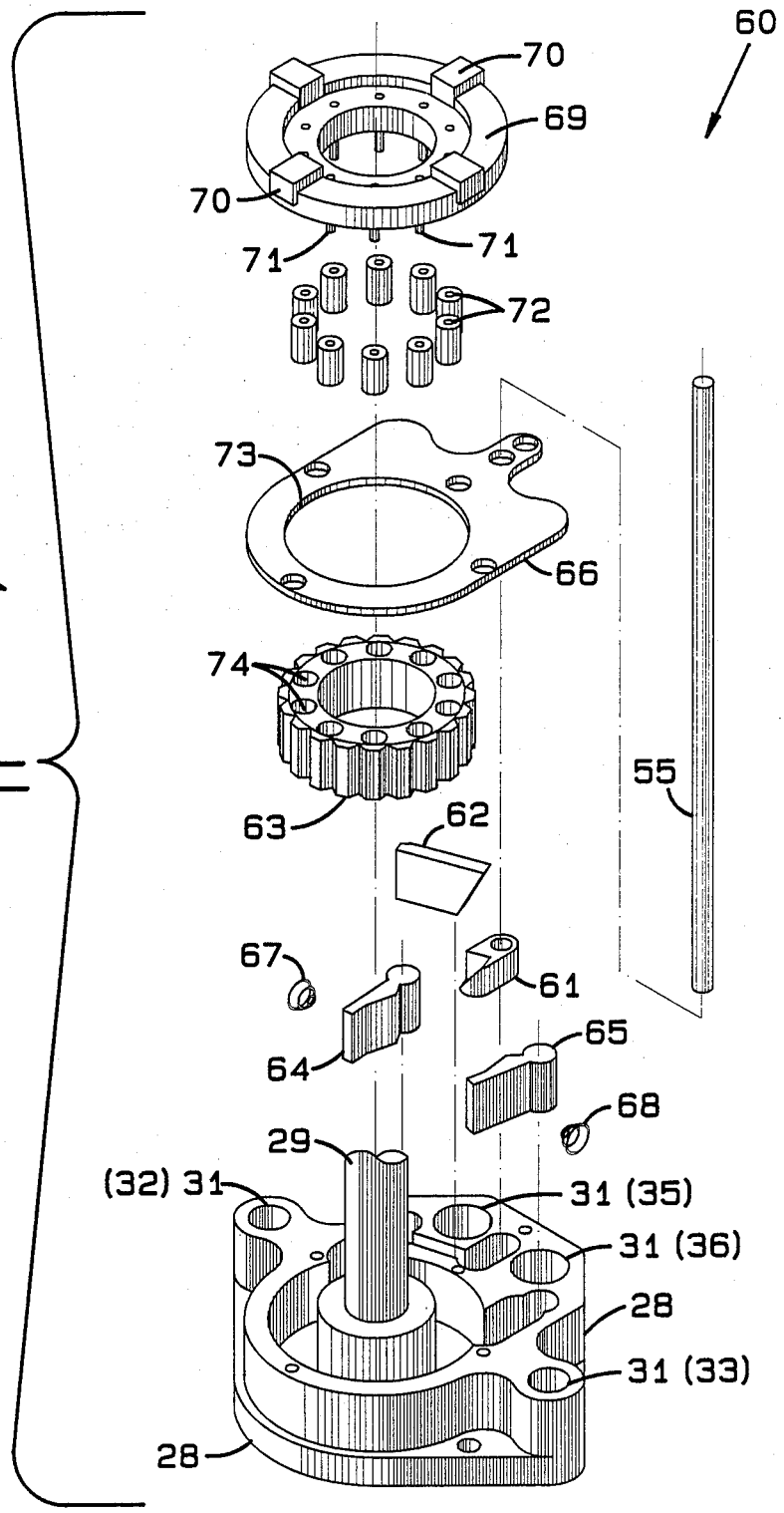
FIG. 5 is an exploded view of the carrier base member and the primary components of a preferred embodiment of the bobbin control means according to the invention.

Each barrel 53 interconnected by an actuator medial portion 52 may seat the free or reactive end of a compression spring 54 housed within each hollow post 35 and 36. The two springs 54 normally bias or force the actuator 50 to a rest or stop against the upper surface of the base member 28 (the position shown in FIG. 3). The longer stud 43 mounting the third and fifth strand guide rollers 42 and 48 projects laterally from the medial portion 52 of the actuator 50. Inwardly of the roller stud 43, the medial portion 52 has a cylindrical bore (not shown) extending therethrough and coaxially receiving a reciprocating rod 55 projecting into the interior of the base member 28.

The upper end of the reciprocating rod 55 may be journaled through the post top plate 34. The medial portion of the rod 55 carries a positionable actuator contact collar 56 which also seats the free or reactive end of a compression spring 57. The spring 57 normally biases or urges the reciprocating rod 55 to a rest or stop within the base member 28.

During operation of a conventional strand fabricating machine mounting a series of rotating carriers 20, the normal tension of material strands 24 moving from bobbins 21 toward the braid point will cause the strand rollers 42 and 48 of the strand guide means to move the slide actuator 50 against the force of the springs 54. A further increase in the tension of a strand 24 will cause the slide actuator 50 to contact and move the rod actuator collar 56 against the force of the spring 57, permitting the bobbin 22 to rotate.

Any resultant increment or change for the relative position of the reciprocating rod 55 within the carrier base member 28 will react on a means (60) to control bobbin rotation around the carrier axial post 29 during movement of the strand material 24. The bobbin control means carried by and mounted within the base member 28 is referred to generally by the numeral 60.

The bobbin control means 60 has five movable components housed in suitably shaped cavities in the base member 28. These components are: a finger cam 61 to be connected to the reciprocating rod 55; a free cam 62 to be moved by the finger cam 61; a ratchet gear 63 to be rotated around the base of the bobbin post 29; a first pawl cam 64 normally spring biased to prevent ratchet gear 63 rotation in one direction (e.g. clockwise), and, a second pawl cam 65 normally spring biased to prevent ratchet gear 63 rotation in a second direction (e.g. counter-clockwise).

Assuming that the bobbin 21 is rotated clockwise, when looking toward the base member 28, for movement of strand material 24 toward a braid point of the conventional strand fabricating machine (not shown), and further assuming that the reciprocating rod 55 is moved upwardly by an increase in tension of the strand material 24 and toward the contact collar 56 against the compression spring 57, the operation of the bobbin control means 60 and control elements 61–65 is as follows: The finger cam 61 will be raised moving the free cam 62. The free cam 62 will permit the ratchet gear 63 to rotate by moving the first pawl cam 64 from locking engagement with the teeth of gear 63. When the reciprocating rod 55 is moved downwardly by a decrease in tension of the strand material 24, lowering of the finger cam 61 will permit the free cam 62 to slide away from the first pawl cam 64. The normal bias (of spring 67) will return pawl cam 64 into locking engagement with the teeth of ratchet gear 63. The function of the second pawl cam 65 is to prevent rotation of the ratchet gear 63 unless or until the reciprocating rod 55 has been moved upward in a predetermined increment or change in relative position.

The bobbin control means 60 further has a detachable cover plate 66 around the axial post 29 and closing over the interior of base member 28 and the suitably shaped cavities and retaining the movable components (61, 62, 63, 64 and 65) and compression spring 67 and 68 (for the cam pawls 64 and 65) therein.

The bobbin control means 60 further has above the cover plate 66, a spool drive ring 69 having projecting flanges 70 interconnecting with a spool base or control side flange 25. The drive ring 69 is connected to the ratchet gear 63. As shown, the base of the drive ring 69 has a circular series of studs 71. Preferably, the ring studs 71 mount elastomeric or resilient cylindrical bushings 72 positionable through a large circular bore 73 in the cover plate 66. The bushings 72 are tightly inserted within corresponding cavities 74 in the ratchet gear 63.

As shown and described, the movable components of the control means 60 housed in the suitably shaped cavities in the base member 28 provide a compact, light weight, inexpensive and easy to service mechanism for controlling rotation of strand supply bobbin 21. This is because in the preferred embodiment the free cam 62, the ratchet gear 63, and the pawl cams 64 and 65 biased by the compression springs 67 and 68, are each oriented within the base member 28 and movable in a common plane perpendicular to the axis of rotation of the spool 22.

Further, the use of the resilient or elastomeric bushings 72 in the interconnection between ratchet gear 63 and the spool drive ring 69 will reduce the mechanical or torque forces during the starting and stopping of bobbin rotation as a consequence of strand movement and resulting variation or change in tension of the strand material 24.

What is claimed is:

1. A bobbin carrier having a base member for operational mounting before a braid point on a strand fabricating machine; said bobbin comprising a spool, a package of wound strand material and a letoff length or free end of strand material extending in a movement path from said bobbin to said braid point, said bobbin spool having a hub and a control flange and an opposed side flange carried by said hub, said carrier base member having an axial post for rotatable mounting of said bobbin, said carrier further having post means located radially around said axial post, said post means supporting means for guiding said strand along said movement path, means for tensioning a moving strand in contact with said guide means, a reciprocating rod movable in response to said strand tensioning means and projecting into said base member, and a means to control bobbin rotation around said axial post during said strand path movement, said bobbin control means being carried by and mounted within said base member, said base member having cavities, said control means having movable components housed in said cavities in said base member and including: a finger cam connected to said reciprocating rod; a free cam movable by said finger cam; a ratchet gear rotatable around the base of said axial post; a first pawl cam normally biased to prevent rotation of said ratchet gear in one direction (e.g. clockwise); and, a second pawl cam normally biased to prevent rotation of said ratchet gear in a second direction (eg. counter-clockwise).

2. A bobbin carrier according to claim 1 wherein said free cam, ratchet gear and biased pawl cams are each oriented within said base member and movable in a common plane perpendicular to the axis of rotation of said spool.

3. A bobbin carrier according to claim 1 further having a detachable cover plate around said axial post and closing over the interior of said base member and said suitably shaped cavities, and a spool drive ring above said cover plate interconnecting with said spool control side flange, said drive ring being attached to said ratchet gear through said cover plate.

4. A bobbin carrier according to claim 3, wherein said ratchet gear has a plurality of cavities, said spool drive ring has a series of studs, and a plurality of resilient bushings mounted on said studs are inserted within said ratchet gear cavities.

5. A bobbin carrier according to claim 1, wherein said post means comprise opposed posts and intermediate hollow posts which are located radially around said axial post in a series of four sockets (31), two of said sockets mounting said opposed posts (32, 33) extending upwardly to mount a top plate (34) for a structural support, and two of said sockets mounting said intermediate hollow posts (35, 36) between said two opposed posts.

6. A bobbin carrier according to claim 5, wherein said post means provide support and mounting for component means for guiding said strand material in said movement path, comprising: a guiding surface on one of said opposed posts, a first roller (38), a second roller (40), a third roller (42), a fourth roller (44), a fifth roller (48), and an eyelet (49).

7. A bobbin carrier according to claim 5, wherein said means for tensioning a moving strand in contact with said guide means includes a slide actuator (50) having a medial portion (52) interconnecting a pair of cylindrical barrels (53) housed within the hollow interiors of said intermediate posts (35, 36), the facing sides of said intermediate posts each having a vertically directed elongate slot (51), each said post slot receiving an actuator side flange extending laterally from said actuator medial portion to an adjacent actuator barrel.

8. A bobbin carrier having a slide actuator according to claim 7, wherein: each said actuator barrel seats a compression spring (54) housed within each said intermediate post; a stud mounting two rollers (42 and 48) of said guide means projects laterally of said actuator medial portion; and, said reciprocating rod extends through said actuator medial portion inwardly of said roller stud.

* * * * *